US007506835B2

(12) United States Patent
Huang

(10) Patent No.: US 7,506,835 B2
(45) Date of Patent: Mar. 24, 2009

(54) TAPE DISPENSER WITH REEL BRAKE

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 106 days.

(21) Appl. No.: 11/764,306

(22) Filed: Jun. 18, 2007

(65) Prior Publication Data

US 2008/0290212 A1 Nov. 27, 2008

(51) Int. Cl.
*B65H 75/26* (2006.01)

(52) U.S. Cl. ..... 242/588; 242/422.5; 156/577; 156/579

(58) Field of Classification Search ..... 242/588, 242/588.2, 422.5; 156/574, 577, 579, 523, 156/527, 526; 225/20, 23, 56, 59, 77, 91
See application file for complete search history.

(56) References Cited

U.S. PATENT DOCUMENTS

| | | | | |
|---|---|---|---|---|
| 4,762,586 | A * | 8/1988 | Wilkie | 156/527 |
| 5,110,401 | A * | 5/1992 | Huang | 156/527 |
| 5,549,255 | A * | 8/1996 | Huang | 242/422.5 |
| 5,725,726 | A * | 3/1998 | Yu | 156/577 |
| 6,257,298 | B1 * | 7/2001 | Huang | 156/577 |
| 6,641,081 | B2 * | 11/2003 | Huang | 242/588 |

* cited by examiner

*Primary Examiner*—William A Rivera
(74) *Attorney, Agent, or Firm*—Browdy and Neimark, P.L.L.C.

(57) ABSTRACT

A tape dispenser includes a base, an axle on the base, a tape reel fitted to the axle and a brake device. The axle has a fixing portion. The brake device has a base member with a hole complementary to the fixing portion and a friction member. The brake device fitted to the axle with the hole engaged with the fixing portion for restriction the brake device from rotation and with the friction member pressing the tape reel to provide the tape reel a friction when the tape reel rotates to provide the tape a tension for cutting off.

6 Claims, 5 Drawing Sheets

TAPE DISPENSER WITH REEL BRAKE

BACKGROUND OF THE INVENTION

1. Field of the Invention

The present invention relates generally to a tape dispenser, and more particularly to a tape dispenser with a reel brake.

2. Description of the Related Art

Typically, a conventional hand-held tape dispenser is provided with a reel to mount a tape roll thereon for free rotation and a cutter to cut off a tape of the tape roll. To benefit the cutter cutting the tape off, the tape has to been tensioned so that a free-rotational reel cannot provide the tape a predetermined tension. An improved tape dispenser provides a brake on the reel so that the reel may tension the tape for cutting.

FIG. 1 shows a conventional tape dispenser 90 having a base 91, on which a bore 92 and an axle 93 are provided, a brake device 94 and a reel 96. The brake device 94 has a post 95 and a C-shaped clip. The brake device 94 is fitted to then axle 93 and has the post inserted into the bore 92, so that the brake device 94 cannot rotate. The reel 95 is fitted to the axle 93 and the clip of the brake device 94 presses a hub of the reel 95 so that the brake device 94 may provide the reel 95 a resistance when the reel 95 rotates.

This conventional tape dispenser must drill the bore 92 on the base 91 that the bore 92 will be left for nothing when the brake device 94 is damaged.

SUMMARY OF THE INVENTION

The primary objective of the present invention is to provide a tape dispenser with a brake device and without having to drill a bore on the base.

According to the objective of the present invention, a tape dispenser includes a base, an axle on the base, a tape reel fitted to the axle and a brake device. The axle has a fixing portion. The brake device has a base member with a hole complementary to the fixing portion and a friction member. The brake device fitted to the axle with the hole engaged with the fixing portion for restriction the brake device from rotation and with the friction member pressing the tape reel to provide the tape reel a friction when the tape reel rotates.

DETAILED DESCRIPTION OF THE INVENTION

Figure 1:
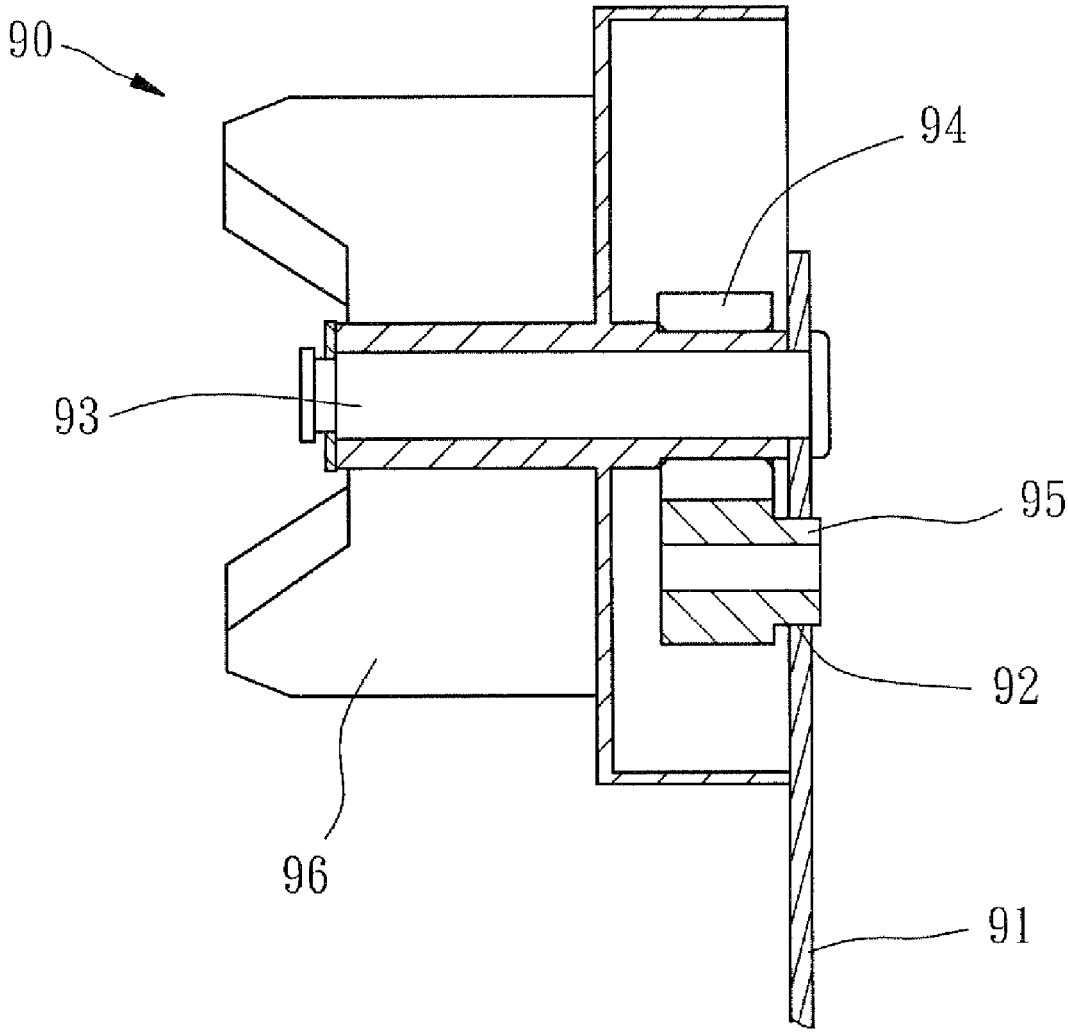
FIG. 1 PRIOR ART
FIG. 1 is an exploded view of the conventional tape dispenser.
Figure 2:
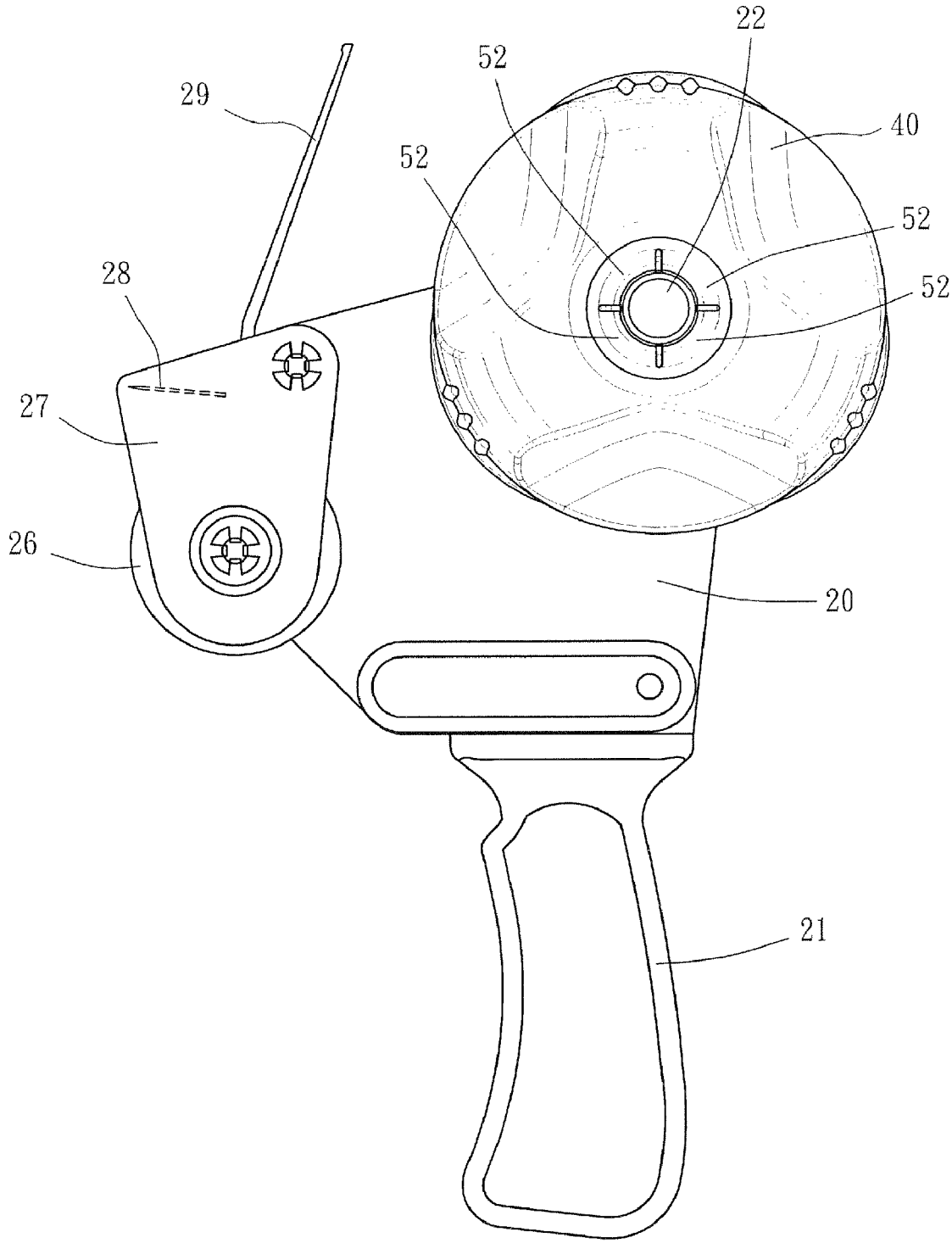
FIG. 2 is a front view of a preferred embodiment of the present invention.
Figure 3:
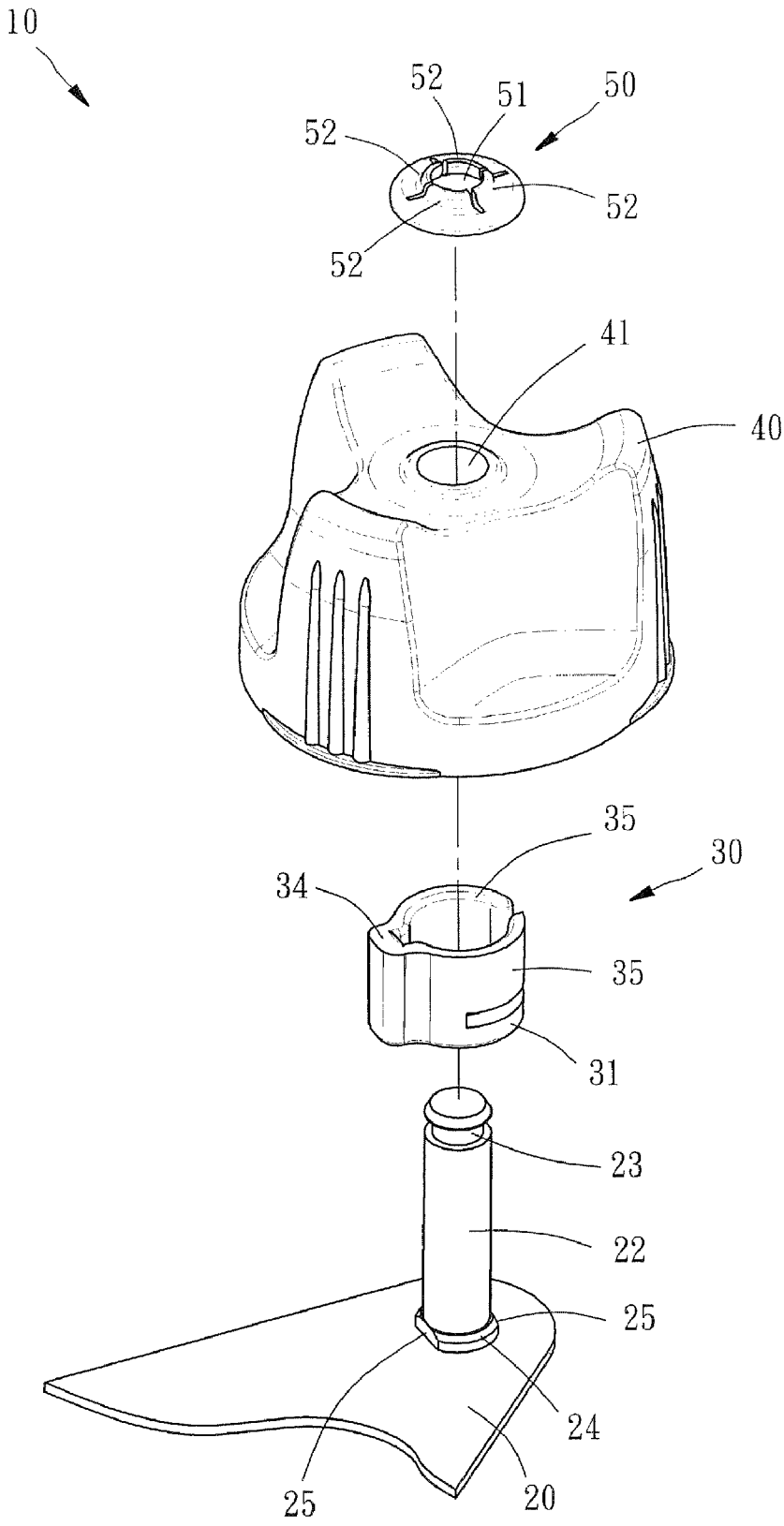
FIG. 3 is an exploded view in parts of the preferred embodiment of the present invention, showing the brake device.

As shown in FIG. 2 to FIG. 6, a tape dispenser 10 of a preferred embodiment of the present invention includes:

As shown in FIG. 2 and FIG. 3, a base 20, which is a plate, is fixed with a handle 21 on a bottom thereof, an axle 22, on which a tape reel 40 is provided, on a rear side thereof, a roller 26 and a cutter base 27, on which a cutter 28 and a wipe plate 29 are provided, on a front side thereof. The axle 22 is provided with an annular slot 23 adjacent to a distal end and a fixing portion 24 at a root end. The fixing portion 24 includes two flat portions 25 at opposite sides. The tape reel 40, on which a tape roll (not shown) is mounted, has a hub 41 at a center thereof to be fitted to the axle 22.

Figure 4:
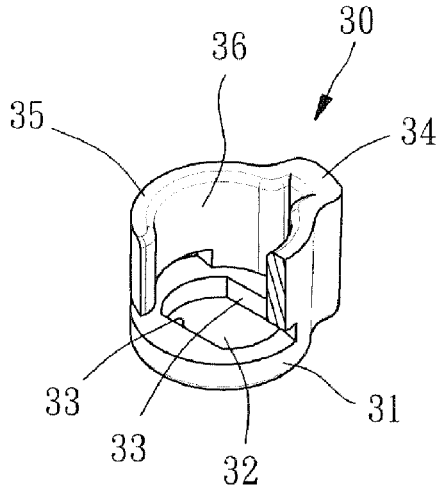
FIG. 4 is a perspective view in combination of FIG. 3, showing the inside structure.
Figure 5:
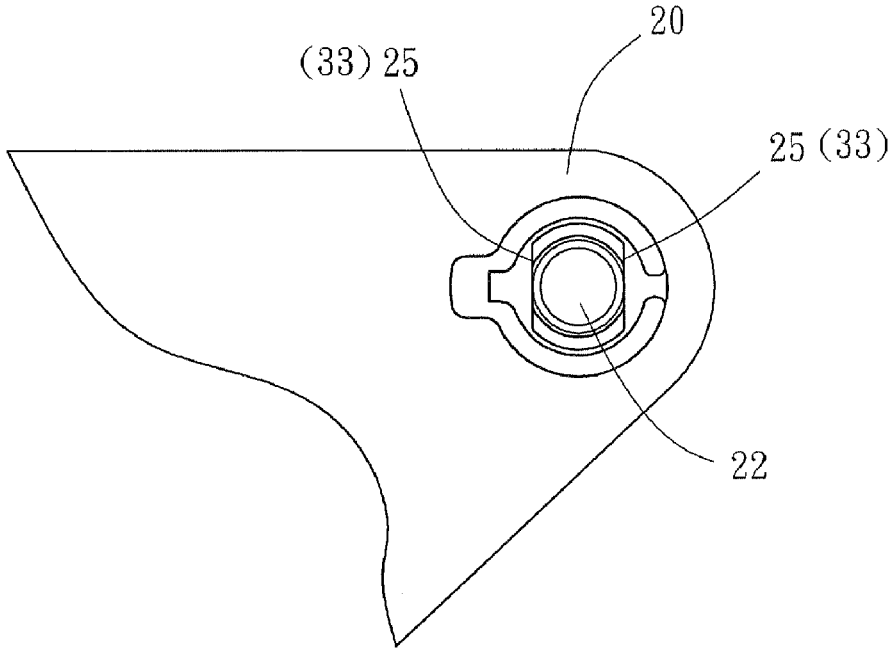
FIG. 5 is a sectional view of the preferred embodiment of the present invention, showing the engagement of the fixing portion and the brake device.
Figure 6:
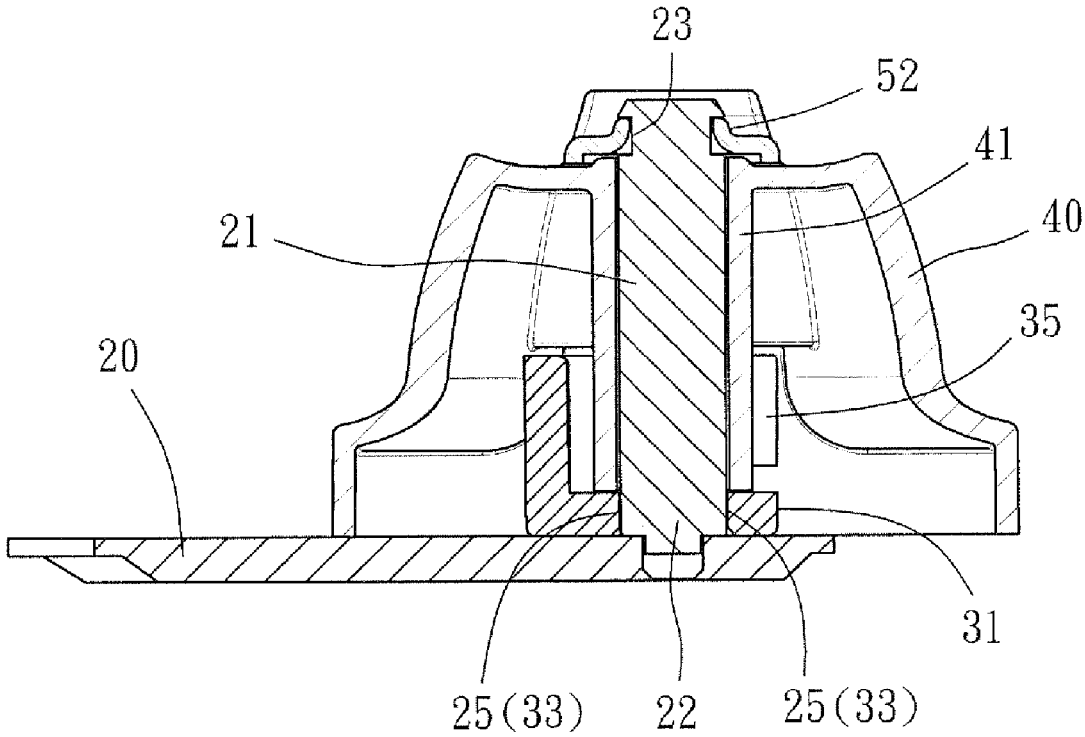
FIG. 6 is a sectional view of the preferred embodiment of the present invention, showing the axle, tape reel and the brake device.

As shown in FIG. 4, a brake device 30 has a base member 31 and a friction member 34. The base member 31 has a hole 32, which is complementary to the fixing portion 24 of the axle 22, having two flat portions 33. The friction member 34, which has an end connected to the base member 31 and the other end suspended, includes two flexible arms 35 enclosing a hole therebetween. The brake device 30 is fitted to the axle 22 with the hole 32 of the base member 31 engaged with the fixing portion 24 (the flat portions 25 and 33 of the fixing portion 23 and the brake device 30 match with each other), referring to FIG. 5, so that the brake device 30 cannot rotate relative to the axle 22. The tape reel 40 is fitted to the axle 22 with the hub 41 been pressed by the flexible arms 35, referring to FIG. 6. At least, a secure device 50, which has a hole 51 and four flexible pieces 52 around the hole 51, is fitted to the axle 22 to have the flexible pieces 52 entering the slot 23, referring to FIG. 6, that the tape reel 40 will not escape from the axle 22.

When user draws a tape of the tape roll out, it will rotate the tape reel 40 that a relative rotation is occurred between the flexible arms 35 of the brake device 30 and the hub 41 of the tape reel 40 to produce a friction on the hub 41 so that the tape will have a predetermined tension to benefit the cutter 28 cutting the tape off.

There is no bore on the base 20 for engagement with the brake device that the base 20 may be incorporated in other tape dispensers. And the tape dispenser may look like a regular tape dispenser when the brake device is damaged. The character of the present invention is that we provide the fixing portion 24 on the axle 22 to restrict the brake device 30 from rotation. We provide the fixing portion 24 with two flat portions 25. In practice, the fixing portion may be a triangle, rectangle, ellipse or any non-circular aspect, and the hole 32 on the base member 31 of the brake device 30 is changed complementary to the fixing portion 24.

The description above is a few preferred embodiments of the present invention and the equivalence of the present invention is still in the scope of the claim of the present invention.

What is claimed is:

1. A tape dispenser, comprising a base, an axle, which has a fixing portion, on the base, a tape reel fitted to the axle and a brake device, wherein the brake device has a base member with a hole complementary to the fixing portion to be engaged with the fixing portion for restriction the brake device from rotation and a friction member pressing the tape reel to provide the tape reel a friction when the tape reel rotates.

2. The tape dispenser as defined in claim 1, wherein the fixing portion has a non-circular aspect.

3. The tape dispenser as defined in claim 1, wherein the fixing portion has at least a flat portion thereon.

4. The tape dispenser as defined in claim 1, further includes a secure device securing on the axle to restrict the tape reel from escaping, wherein the secure device has a hole and a plurality of flexible pieces around the hole.

5. The tape dispenser as defined in claim 4, wherein the axle has an annular slot thereon for engagement with the flexible pieces of the secure device.

6. The tape dispenser as defined in claim 1, wherein the friction member of the brake device has at least a flexible arm to press the tape reel.

* * * * *